US005176598A

United States Patent [19]

Gardner

[11] Patent Number: 5,176,598

[45] Date of Patent: Jan. 5, 1993

[54] FOOT AMBULATOR APPARATUS

[76] Inventor: Gordon B. Gardner, 1960 Eaton St., Unit 8, Lakewood, Colo. 80214

[21] Appl. No.: 879,296

[22] Filed: May 7, 1992

[51] Int. Cl.[5] ..... A63B 23/10

[52] U.S. Cl. ..... 482/79; 128/25 B

[58] Field of Search ..... 482/79, 80, 148; 128/25 R, 25 B, 48

[56] References Cited

U.S. PATENT DOCUMENTS 3,526,220 9/1970 Small ..... 128/25 B 4,862,875 9/1989 Heaton ..... 482/79

*Primary Examiner*—Stephen R. Crow

*Attorney, Agent, or Firm*—Leon Gilden

[57] ABSTRACT

An apparatus to simulate typical walking and ambulation of an individual includes a housing formed with a drive motor directed through a gear housing, with the gear housing including output shafts mounted in turn fixedly to respective right and left cam flanges that are arranged in a parallel relationship rotatably offset relative to one another one hundred eighty degrees. The cam flanges are linked to rear foot support plates of a pair of foot support members, wherein the rear foot support plates are hingedly mounted relative to forward foot support plates and the forward foot support plates are pivotally mounted through a slotted arrangement relative to the housing, whereupon actuation of the drive motor effects simulation of walking. Spring biased securement bands are provided about each foot plate to secure an individual's feet thereon.

7 Claims, 4 Drawing Sheets

FOOT AMBULATOR APPARATUS

BACKGROUND OF THE INVENTION

1. Field of the Invention

The field of invention relates to exercise and therapy apparatus, and more particularly pertains to a new and improved foot ambulator apparatus wherein the same is directed to provide for enhanced circulation and muscle stimulating exercise to an individual's feet and associated joint structure.

2. Description of the Prior Art

Prior art directed to exercise and therapy apparatus include U.S. Pat. Nos.:

| | |
|---|---|
| 4,973,046 | 4,650,183 |
| 4,474,176 | 4,446,855 |
| 4,299,206 | 4,294,236 |
| 4,280,486 | 4,177,803 |

Regular exercise directed to convalescing patients, invalid individuals, and the like is required in proper treatment and therapy of such individuals in effecting circulation and muscle stimulation through exercise of the lower limb portions of the individual's legs. To this event, the instant invention is specifically directed to ambulatory simulation structure to effect simulated walking directed to an individual's feet for proper stimulation of the muscles, improved circulation, and flexure to the individual's lower limbs and including the arch of the foot. Heretofore, the prior art has directed itself primarily to vibratory devices and heat alone without completely addressing the need to associate such structure with natural movement to the lower limb portions, and more specifically the feet of individuals. To this event, the instant invention attempts to address the problems of ease of use as well as effectiveness in construction in providing a foot ambulator apparatus directed to the provision of such therapeutic movement directed to an individual's lower limbs and in this respect, the present invention substantially fulfills this need.

SUMMARY OF THE INVENTION

In view of the foregoing disadvantages inherent in the known types of therapy apparatus now present in the prior art, the present invention provides a foot ambulator apparatus wherein the same is directed to simulation of natural walking and associated flexure to an individual's feet. As such, the general purpose of the present invention, which will be described subsequently in greater detail, is to provide a new and improved foot ambulator apparatus which has all the advantages of the prior art therapy apparatus and none of the disadvantages.

To attain this, the present invention provides an apparatus to simulate typical walking and ambulation of an individual including a housing formed with a drive motor directed through a gear housing, with the gear housing including output shafts mounted in turn fixedly to respective right and left adjustable throw cam flanges that are arranged in a parallel relationship rotatably offset relative to one another one hundred eighty degrees. The adjustable throw cam flanges are linked to rear foot support plates of a pair of foot support members, wherein the rear foot support plates are hingedly mounted relative to forward foot support plates and the forward foot support plates are pivotally mounted through a slotted arrangement relative to the housing, whereupon actuation of the drive motor effects simulation of walking. Spring biased securement bands are provided about each foot plate to secure an individual's feet thereon.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved foot ambulator apparatus which has all the advantages of the prior art therapy apparatus and none of the disadvantages.

It is another object of the present invention to provide a new and improved foot ambulator apparatus which may be easily and efficiently manufactured and marketed.

It is a further object of the present invention to provide a new and improved foot ambulator apparatus which is of a durable and reliable construction.

An even further object of the present invention is to provide a new and improved foot ambulator apparatus which is susceptible of a low cost of manufacture with regard to both materials and labor, and which accordingly is then susceptible of low prices of sale to the consuming public, thereby making such foot ambulator apparatus economically available to the buying public.

Still yet another object of the present invention is to provide a new and improved foot ambulator apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
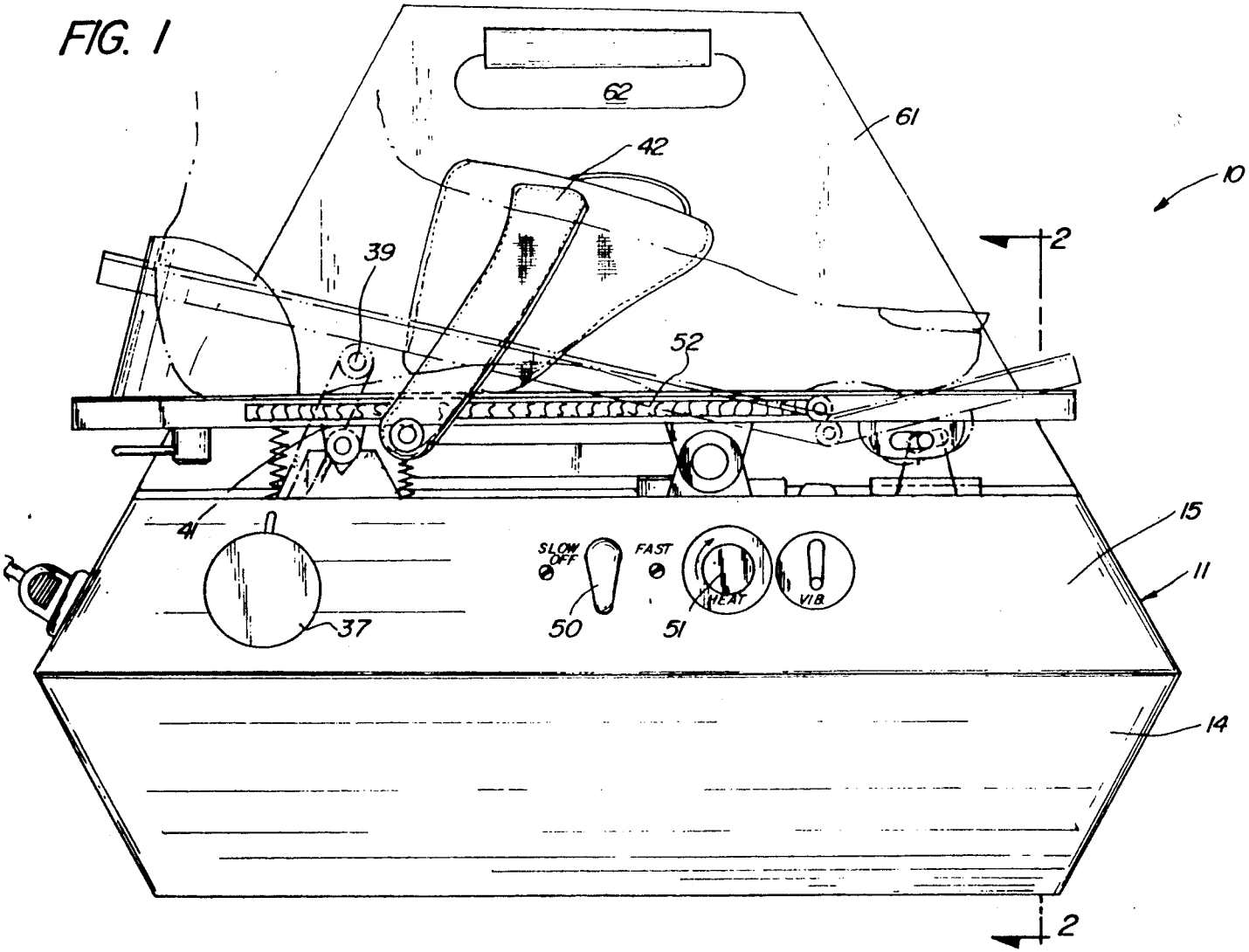
FIG. 1 is an orthographic side view of the invention, taken in elevation.
Figure 2:
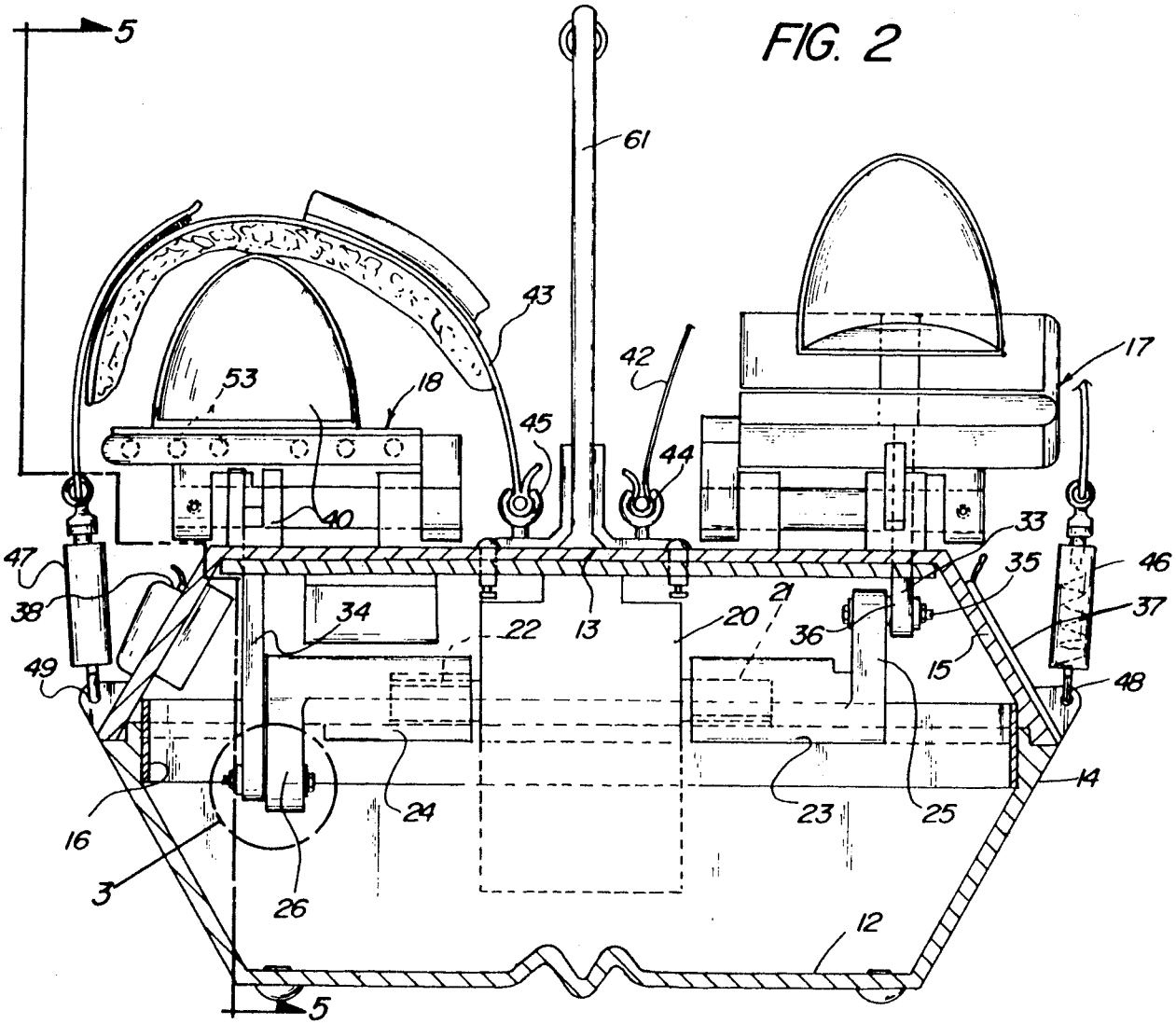
FIG. 2 is an orthographic view, taken along the lines 2—2 of FIG. 1 in the direction indicated by the arrows.
Figure 4:
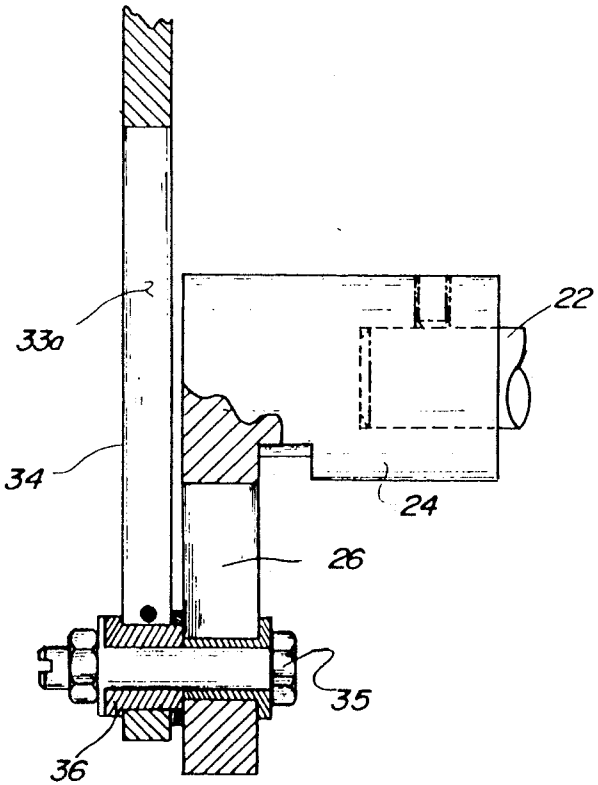
FIG. 4 is an orthographic view, taken along the lines 4—4 of FIG. 3 in the direction indicated by the arrows.
Figure 3:
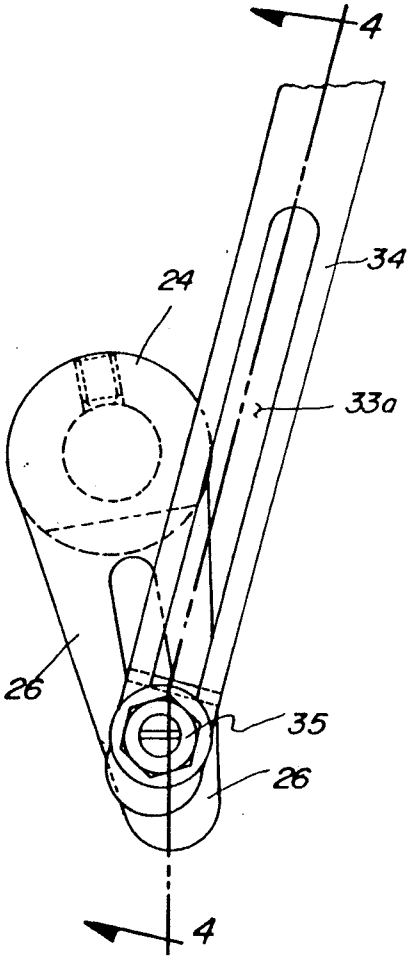
FIG. 3 is an orthographic of section 3, as set forth in FIG. 2.
Figure 5:
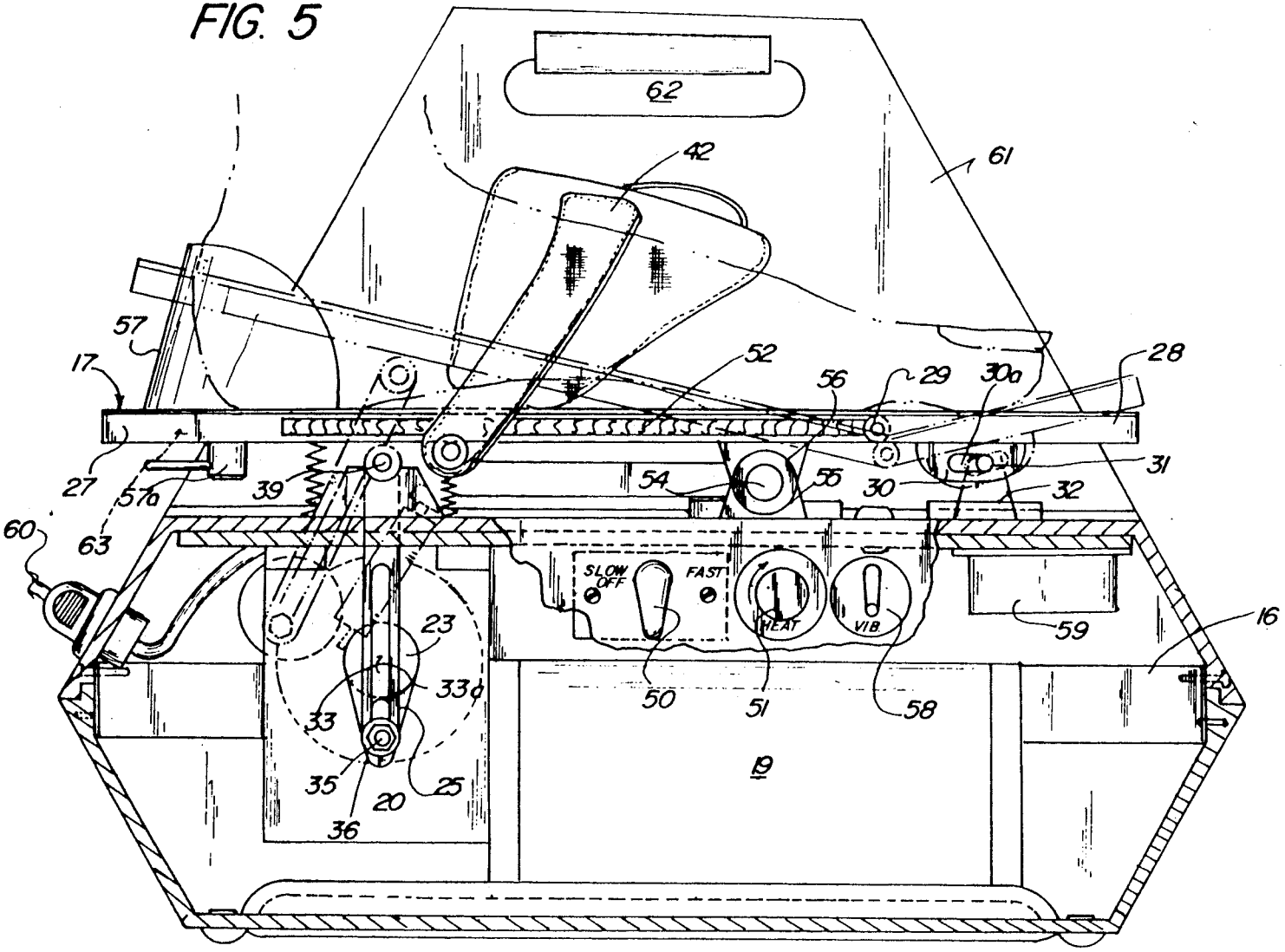
FIG. 5 is an orthographic side view, partially in section, of the instant invention.

With reference now to the drawings, and in particular to FIGS. 1 to 5 thereof, a new and improved foot ambulator apparatus embodying the principles and concepts of the present invention and generally designated by the reference numeral 10 will be described.

More specifically, the foot ambulator apparatus 10 of the instant invention essentially comprises a housing 14 formed with a housing floor 12 spaced from and parallel a housing top wall 13. A lower continuous side wall 14 is mounted to an upper continuous side wall 15, wherein the lower and upper side walls 14 and 15 intersect at an acute included angle therebetween projecting exteriorly beyond the forward and top wall structure, with a securement band 16 mounted within the housing (or optionally exteriorly thereof) for securement of the housing in an assembled configuration, as illustrated. A right foot support 17 and a left foot support 18 are movably mounted to the housing top wall 13 in a parallel relationship. A drive motor 19 including a vibratory capacity is mounted to the floor 13 of the housing 15 in cooperation with a gear housing 20. A right and left output shaft 21 and 22 respectively that are coaxially aligned project exteriorly of the gear housing 20. A right and left drive shaft sleeve 23 and 24 are respectively mounted fixedly to the right and left output drive shafts 21 and 22, with the right drive shaft sleeve 23 including a right cam flange 25 and the left drive shaft sleeve 24 including a left cam flange 26. The right and left cam flanges 25 and 26 are offset relative to one another one hundred eighty degrees, but wherein as the right and left drive shafts 23 and 24 are mounted utilizing a locking screw configuration such as illustrated in the FIG. 4, may be reoriented if so desired. The right and left foot supports 17 and 18 are of identical construction where it is understood that description of one is directed to description of both. In this vein, a rear foot support plate 27 is hingedly mounted to a forward foot support plate 28 by a foot support hinge 29. The forward foot support plate 28 includes a forward foot plate flange 30 including a forward foot plate flange slot 30*a* receiving a forward foot plate flange axle 31 therethrough (e.g. note FIG. 5) to effect a sliding connection between the forward foot support plate 28 and a forward foot plate support boss 32 fixedly mounted to the housing top wall 13. A rear foot plate actuator link 33 is adjustably mounted to each cam flange of the right and left cam flanges 25 and 26 and includes an actuator link slot 33*a* directed therethrough to effect a sliding adjustable relationship relative to the link 33 and a respective cam flange by use of a link fastener 35 that is directed through a bushing structure 36 (see FIGS. 3 and 4) to permit a sliding inter-relationship between the fastener and the link through the slot structure 34 to control the relative lift of the link to the associated rear foot support plate 27 of the right and left foot supports 17 and 18. To accommodate this adjusting relationship, a respective right and left access door 37 and 38 are directed through the upper side wall 15 in adjacency relative to the right and left cam flanges 25 and 26 to permit access to the link fastener 35 of each cam flange. An actuator link upper axle 39 at each actuator link upper end 40 is mounted to each rear foot plate and more specifically to a rear foot plate mounting flange 41 fixedly and orthogonally projecting downwardly relative to each rear foot plate 27. Further, a rear foot plate forward support axle 54 parallel to the foot support hinge 29 mounts the rear foot plate to the forward foot support axle housing boss 55 that is mounted to the housing top wall 13 and to a forward support axle foot plate boss 56. A heel support 57 is further provided in positioning of the foot relative to the support plate structure. The heel support 57 may be provided with longitudinal adjustment about a heel support fastener 57*a* (see FIG. 5) that may be mounted within an associated slot structure 63 to provide for adjustment of the heel support relative to the rear foot support plate 27 of each foot support 17 and 18. A respective right and left securement band 42 and 43 of flexible construction is mounted overlying each respective rear foot support plate 27 of each right and left foot support 17 and 18, and includes a respective right and left interior band anchor 44 and 45 fixedly mounted to the housing top wall 13, with an outer distal end of each securement band 42 and 43 mounted to a respective right and left spring housing 46 and 47 permitting adjustable securement of each outer distal end of each securement band for the comfortable securement of each foot into a respective right and left foot support 17 and 18 of the structure. The right and left spring housings 46 and 47 are mounted respective right and left pivot junctions 48 and 49, especially at the intersection of the upper and lower side walls 15 and 14 to project the spring housings for clearance relative to the housing structure. A motor control 50 is provided to effect motor speed of the drive motor 19, as well as the use of a heater control 51 to effect operation of heating transformer 59 to effect selective heating of right and left resistance heating coils 52 and 53 within the rear foot support plates 27. Vibratory control 58 is further provided as optional to permit imparting of vibratory energy through vibratory unit. An electrical power supply 60 directs energy to the organization, wherein for further convenience in use of the organization, a transport flange 61 fixedly and orthogonally mounted medially of the right and left foot supports 17 and 18 projects upwardly relative thereto mounted to the top wall 13, with the transport flange 61 including a flange opening 62 for manual grasping of the flange for ease of transport of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A foot ambulator apparatus, comprising, a housing, the housing including a housing floor spaced from and parallel a housing top wall, side wall means mounted in surrounding relationship relative to the housing between the top wall and the floor for projection laterally beyond the top wall and the floor, a right foot support and a left foot support arranged in a parallel coextensive relationship movably mounted relative to the top wall, the right foot support and the left foot support each include a forward foot support plate longitudinally aligned with a rear foot support plate, a foot support hinge hingedly mounting each forward foot support plate to a respective rear foot support plate, a drive motor mounted fixedly within the housing below the top wall directed into a gear housing, with the gear housing including a right output shaft and a left output shaft, wherein the right output shaft and the left output shaft are coaxially aligned relative to one another projecting beyond the gear housing, wherein the right output shaft and the left output shaft include respective right and left drive shaft sleeves mounted to the respective right output shaft and left output shaft, the right sleeve includes a right cam flange orthogonally oriented relative to the right sleeve, the left sleeve includes a left cam flange orthogonally and fixedly mounted to the left sleeve, and a right drive link mounted between the right cam flange and the right foot support, and a left drive link mounted between the left cam flange and the left foot support, whereupon actuation of the drive motor effects rotation of the right output shaft and the left output shaft for reciprocation of the right drive link and the left drive link for reciprocation of the respective right foot support and the left foot support relative to the housing top wall.

2. An apparatus as set forth in claim 1 wherein each drive link includes a drive link slot, and a right fastener directed through the right drive link, and a left fastener directed through the left drive link for securement to the respective right adjustable cam flange and left adjustable cam flange, and a right access door directed through the side wall means, wherein the right access door is removably mounted relative to the side wall means for access to the right drive link, and a left access door removably mounted relative to the side wall means for access to the left drive link thus allowing adjustment of the cam flange pitch to accommodate the user's specific therapeutic requirements.

3. An apparatus as set forth in claim 2 including a right lock fastener directed through the right sleeve for rotative adjustment of the right drive sleeve relative to the right output shaft, and a left lock fastener directed through the left drive sleeve in communication with the left output shaft for rotative adjustment of the left drive sleeve relative to the left output shaft.

4. An apparatus as set forth in claim 3 wherein each rear foot plate includes a rear foot plate axle; wherein each axle is arranged parallel relative to each support hinge, and each rear foot plate includes a rear foot plate rear distal end, and each rear foot plate rear distal end is mounted rotatably to a drive link upper distal end, and the right foot support includes a heel support and the left foot support includes a left heel support, wherein the right heel support and the left heel support are adjustably mounted relative to the respective right foot support and the left foot support.

5. An apparatus as set forth in claim 4 wherein the side wall means includes an upper continuous side wall and a lower continuous side wall projecting laterally beyond the housing floor and the housing top wall defining an acute included angle therebetween, and a right securement band mounted over the right foot support, and a left securement band mounted over the left foot support, and the right securement band includes a right band anchor mounted to the top wall, the left securement band includes a left band anchor mounted to the top wall, and the right securement band further includes a right spring housing mounted to the side wall means, and the left securement band includes a left spring housing mounted to the side wall means, with the left spring housing pivotally mounted to the side wall means at a lower distal end of the right spring housing, and the left spring housing including a left pivot junction mounted to the side wall means.

6. An apparatus as set forth in claim 5 wherein each rear foot plate includes resistance heating coils mounted therewithin, and the resistance heating coils are in operative communication with a heating transformer mounted within the housing, and control means mounted to the housing for selective actuation of the heating transformer.

7. An apparatus as set forth in claim 6 including a transport flange medially and orthogonally mounted to the top wall extending between the right foot support and the left foot support, with the transport flange including an upper distal transport flange end spaced above the right foot support and the left foot support, and a transport flange opening directed through the transport flange for manual grasping of the transport flange.

* * * * *